United States Patent [19]

Ndebi et al.

[11] Patent Number: 5,053,828

[45] **Date of Patent: * Oct. 1, 1991**

[54] ELECTROSTATOGRAPHIC EQUIPMENT HAVING A MULTIPLE FUNCTION FUSING AND IMAGE TRANSFER ROLLER

[75] Inventors: Sylvain L. Ndebi; Robert D. Bobo, both of Rochester, N.Y.

[73] Assignee: Eastman Kodak Company, Rochester, N.Y.

[ * ] Notice: The portion of the term of this patent subsequent to Oct. 18, 2008 has been disclaimed.

[21] Appl. No.: 453,739

[22] Filed: Dec. 20, 1989

[51] Int. Cl.[5] ..... G03G 15/20

[52] U.S. Cl. ..... 355/285; 219/216; 219/469; 355/271; 355/282; 355/290; 355/312

[58] Field of Search ..... 355/271, 281, 282, 285, 355/290, 312; 269/21; 51/235; 219/469, 216

[56] References Cited

U.S. PATENT DOCUMENTS

| | | | |
|---|---|---|---|
| 3,452,181 | 6/1969 | Stryjewski | 219/216 |
| 3,566,076 | 2/1971 | Fantuzzo et al. | 219/216 |
| 3,827,855 | 8/1974 | Blake | 219/469 X |
| 3,893,800 | 7/1975 | Waks | 432/60 |
| 4,095,886 | 6/1978 | Koeleman et al. | 355/211 X |
| 4,416,531 | 11/1983 | Mayer | 355/271 X |
| 4,588,279 | 5/1986 | Fukuchi et al. | 355/271 |
| 4,639,405 | 1/1987 | Franke | 430/124 |
| 4,731,635 | 3/1988 | Szlucha et al. | 355/290 X |
| 4,791,447 | 12/1988 | Jacobs | 355/290 |

FOREIGN PATENT DOCUMENTS 0134442 11/1978 Japan .

*Primary Examiner*—A. T. Grimley
*Assistant Examiner*—J. E. Barlow, Jr.
*Attorney, Agent, or Firm*—Tallam I. Nguti

[57] ABSTRACT

An electrostatographic copier or printer includes front end apparatus for forming and developing copies of images electrostatically, and back end apparatus which include a multiple function fusing roller that also functions as an image transfer roller. The multi-function fusing apparatus selectively includes a contact fusing operation or a non-contact fusing operation. A vacuum roller holds the copy sheet while either a radiant fuser or a pressure nip fuser will fix a toner image onto the substrate. The vacuum roller may be internally heated and the pressure roller which creates the fusing nip is selectively moved into and out of contact with the vacuum roller dependent upon the operation selected.

12 Claims, 1 Drawing Sheet

ELECTROSTATOGRAPHIC EQUIPMENT HAVING A MULTIPLE FUNCTION FUSING AND IMAGE TRANSFER ROLLER

RELATED APPLICATIONS

This application is related to U.S. patent application Ser. No. 07/453 740, filed on even date herewith on Dec. 20, 1989 in the names of the same inventors Sylvain L. Ndebi and Robert D. Bobo, and entitled "ELECTROSTATOGRAPHIC EQUIPMENT WITH MULTIPLEX FUSER".

BACKGROUND OF THE INVENTION

This invention relates to equipment for electrostatographically producing or reproducing copies of an original image on a suitable substrate. More particularly, the invention relates to such equipment including a multiple function fusing and image transfer roller.

Electrostatographic copies, as is well known, can be conventionally made by forming a toner image on an image bearing member, transferring such toner image to a suitable substrate, and then fusing the transferred toner image to the substrate. Depending on the type of substrate being used, for example, paper, plastic film or metallic plates, it may be desirable to contact fuse the toner image, by contacting and pressing such image onto the substrate, or to non-contact fuse the toner image to such substrate, by merely heating but not contacting the image.

Ordinarily, electrostatographic equipment as disclosed for example in related U.S. patent application Ser. No. 07/453 740, filed on even date herewith on Dec. 20, 1989 in the names of the same inventors Sylvain L. Ndebi and Robert D. Bobo, and entitled "ELECTROSTATOGRAPHIC EQUIPMENT WITH MULTIPLEX FUSER", include separate devices (a) for effecting toner image transfer from the image bearing member to a substrate, and (b) for fusing such image onto the substrate. Conventional equipment, unlike this related patent application, even have separate devices (i) for non-contact fusing of such image, and (ii) for contact fusing of the image. To include all three separate types of devices in one piece of equipment ordinarily would require that the equipment include relatively more components and more parts, and hence that would make such an electrostatographic piece of equipment relatively more elaborate, and more costly.

SUMMARY OF THE INVENTION

It is an object of the present invention to provide an electrostatographic equipment that has relatively few components, is simple and less costly by including partially common and cooperative apparatus (a) for effecting toner image transfer to a substrate, (b) for performing desirable non-contact fusing of such toner image, and (c) for performing contact fusing of such toner image.

In accordance with the present invention, an electrostographic equipment for producing fused toner images on a variety of substrates such as paper, plastic film, and metallic printing press plates is provided. The equipment comprises (a) a front end means, including an image bearing member, for electrostatically forming image patterns of an original image on such image bearing member, and for developing such image patterns with fusible toner particles to form a toner image, and (b) a back end means. The back end means includes a rotatable multiple function fusing and image transfer device having means for receiving and holding a suitable substrate thereon. The multiple function device forms a part of image transfer apparatus for transferring the toner image from the image bearing member onto the substrate.

The back end means further includes (i) non-contact fusing appartus for fusing the toner image onto the substrate without contacting such image, (ii) contact fusing apparatus for fusing the toner image by contacting and pressing such image onto the substrate, and (iii) control means for switching the equipment between a non-contact fusing mode and a contact fusing mode.

BRIEF DESCRIPTION OF THE DRAWING

In the detailed description of the invention below, reference is made to the accompanying drawing in which.

DETAILED DESCRIPTION OF THE PREFERRED EMBODIMENT

Figure 1:
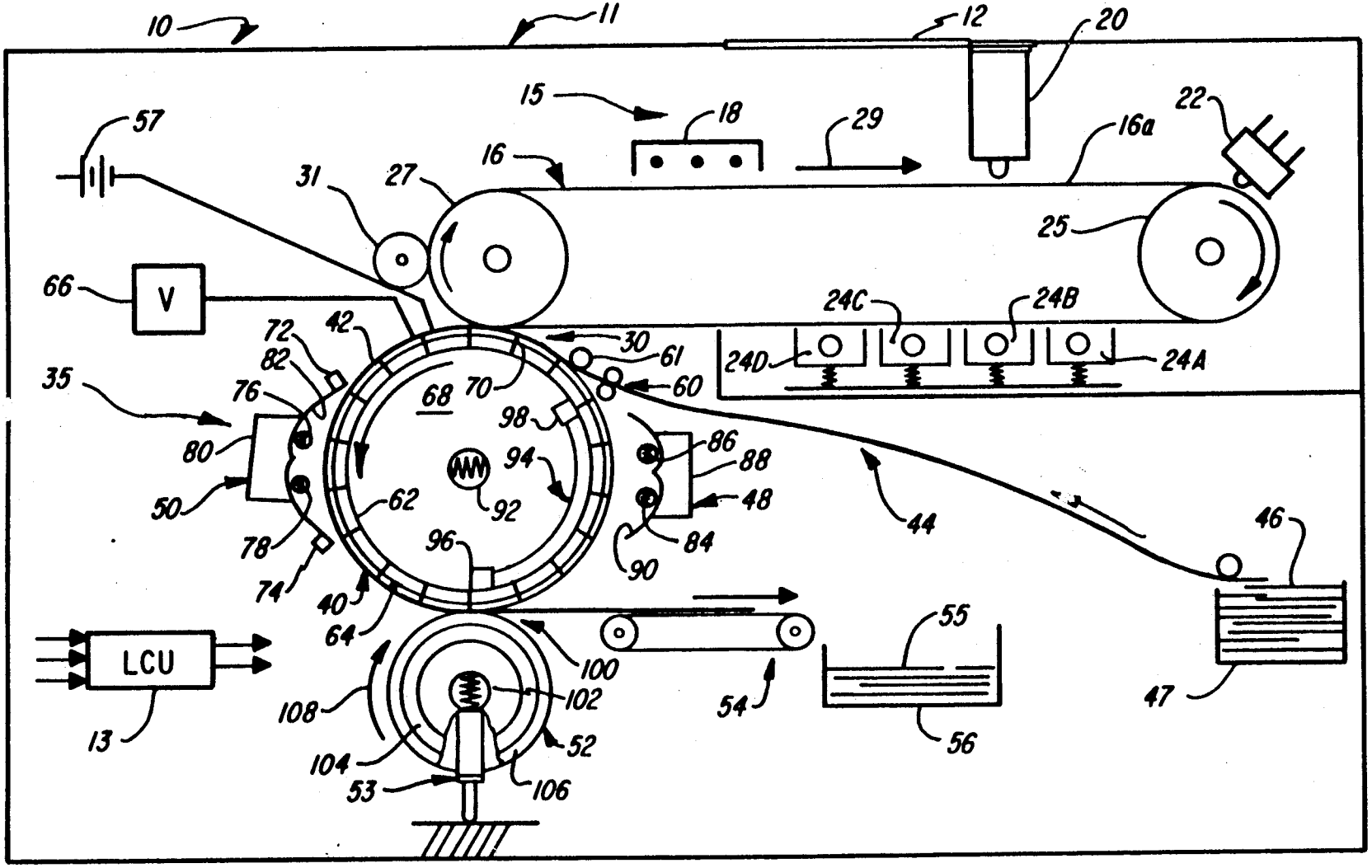
FIG. 1 is a schematic view of an electrostatographic equipment such as a copier or printer including the multiple function fusing and image transfer roller of the present invention.

Referring now to the drawing, an electrostatographic equipment such as a copier or printer is shown generally as 10. Such a piece of equipment, as is well known, is suitable for producing or reproducing copies of an original image on a suitable substrate, for example, a copy sheet of paper.

As shown, the copier or printer 10 includes a frame or housing 11, an original document handling platen 12, a logic and control unit LCU 13, and front end means, designated generally as 15. The front end means 15 are suitable for electrostatically forming image patterns of an original image on an image bearing member and then developing such image patterns with fusible toner particles to form a toner image. The original image may be from an original document placed on the platen 12 for subsequent image exposure, or it may be fed electronically to the means 15.

Accordingly, the means 15 includes an image bearing member 16 having a surface **16*a*, a primary charger 18, a scanning device 20, an electronic printhead 22 and development stations 24A, 24B, 24C and 24D which may each carry toner particles of a different color. As such the equipment 10 can be used to produce monocolor as well as multi-color toner images as is well known in the art. The image bearing member 16 is shown as an endless web trained about a plurality of rollers 25, 27, for movement in the direction of arrow 29, but as is well known, the member 16** can also be a rigid drum mounted for similar rotation.

For the operation of the front end means 15, the primary charger 18 applies a uniform electrostatic charge to the surface **16*a* of the image bearing member 16 as member 16 is moved past the charger. As the charged member 16 is moved further, the uniform charge thereon is image-wise altered by means such as the scanner 20 and/or the electronic printhead 22, thereby electrostatically forming latent image patterns of an original image on the surface 16**.

The latent image patterns thus formed are next moved past the development stations 24A, 24B, 24C and 24. r development with charged toner particles therein. For such development, each toner station can be selectively activated or moved to cause contact between toner particles therein and an image pattern within an image frame of the surface 16a, thereby forming a toner image thereon.

As the member 16 is moved further on, such a toner image is moved into an image transfer nip 30, where such toner image can be transferred from the surface 16a. Thereafter, the surface 16a can be cleaned by a cleaning device 31, in preparation for reuse to form another such toner image.

As further shown, the copier or printer 10 of the present invention also includes back end means designated generally as 35. The back end means 35 includes a rotatable multiple function fusing and image transfer device 40, shown as a roller, having an outside surface 42. The back end means 35 also includes (a) a substrate handling and feeding system 44 for feeding substrates 46 from a supply 47 thereof, (b) radiant heat sources 48, 50 which can be selectively turned on and off, (c) a heated fuser roller 52 including an articulating device 53 for moving the roller 52 into an out of contact engagement with the multiple function roller 40, and (d) a finished copy handling system 54 for conveying fused finished copies 55 to an output tray 56.

In the present invention, the multiple function roller 40 cooperatively forms part of image transfer apparatus for transferring the toner image from the surface 16a of the image bearing member 16 onto a suitable substrate 46. Within the back end means 35, the multiple function roller 40 also forms part of non-contact fusing apparatus for non-contact fusing of the toner image onto the substrate, (following transfer of such image onto such substrate) without contacting such image. The multiple function roller 40 further also forms part of contact fusing apparatus therein for fusing the toner image by contacting and pressing such image onto such substrate.

The image transfer apparatus of the equipment 10 includes the image transfer member 16 for moving the toner image thereon, the multiple function roller 40 which is rotatable by appropriate means (not shown), a source 57 for electrically biasing the roller 40 thereby creating an electrostatic image transfer field, and an image transfer nip 30 formed by the image bearing member 16 and the roller 40. The image transfer apparatus also includes the substrate handling and feeding system 44 for feeding a substrate 46 in timed registration onto the multiple function roller 40, as well as, means for receiving and holding such substrate 46 onto the outside surface 42 of the roller 40.

As the toner image on an image frame of the member 16 is being moved into the transfer nip 30, a substrate 46 is fed, in a timed and registered relation with the arrival into the nip 30 of such toner image, onto, and held on the outside surface 42 of the roller 40 for movement therewith into the nip 30 where the toner image on the image bearing surface 16a can be transferred onto such substrate. The rotation of the roller 40, the movement of the member 16 and the feeding of the substrate 46, as such, are all controlled through the LCU 13. As shown, the timing, registration and securing of the substrate 46 onto the roller 40 may be assisted by a registration gate 60, and a deflection mechanism, such as a roller 61 for deflecting the substrate 46 into contact with the surface 42 of the roller 40.

As shown, the multiple function roller 40 forms the nip 30 with the surface 16a of the member 16 at a point where one of the rollers 27, about which the member 16 is trained, can act as a backup support to the web member 16. Such a back up roller support is of course not necessary when the image bearing member is a rigid drum. For such nip formation, it is preferable that the roller 40 is longitudinally coextensive with the roller 27.

Structurally, the roller 40 consists of a rigid metallic shell 62 that is made, for example, of aluminum and that as such is hollow, and generally cylindrical. The roller 40 may also include a thermally conductive layer 64 that is bonded over the shell 62. In such a case, the layer 64 therefore will include the outer surface 42. Although a single layer 64 is shown, there can be more than one such overlayer. The outermost layer, however, should be sufficiently capacitive electrically so as to enable the establishment of a charge density over the surface 42 when the metal core 62 is electrically biased by the source 57.

For receiving and holding a substrate 46 onto the surface 42 of the roller 40, the roller 40 is connected to a vacuum source 66 by suitable means. The source 66 forms part of vacuum hold down means associated therewith that further include a vacuum chamber 68 coincident with a good part of the hollow interior of the shell 62, and vacuum holes 70 formed in the shell 62 and layer 64. For proper functioning of such vacuum means, the ends of the roller 40 are vacuum sealed.

The vacuum holes 70 are formed in the roller 40 such that they constitute a grid pattern across the length and circumference of the roller 40. A substrate 46 on the surface 42 will therefore normally overlay a segment of such a pattern. When the vacuum source 66 is activated and a substrate 46 is fed in timed registration onto the surface 42, vacuum action through the holes 70 operates to first grip the leading edge of such substrate, and eventually the rest of the substrate, as the roller 40 continues to rotate. Such substrate thereafter will be held onto the surface 42 by such vacuum means until released or removed. As such the roller 40 can be rotated with the substrate 46 being held thereon. Accordingly, a substrate 46 fed onto and held by the roller 40, in timed registration with a toner image coming into the transfer nip 30, will be moved by the roller 40 into the nip 30 for receiving such toner image from the image bearing member 16. Thereafter the (toner image carrying) substrate, while still being held on the roller 40, can then be moved away from the image transfer nip 30, to where the toner image thereon can be fused.

For such fusing, the equipment 10 under the control of the LCU 13, can effectively operate in either a non-contact fusing mode, or in a contact fusing mode. In the non-contact mode, a heated fuser roller 52 is moved out of contact with, and is thus spaced from, the roller 40, and the non-contact fusing apparatus of the back end means 35 then functions to fuse the toner image (on the substrate being held onto the roller 40) without contacting such image.

Such non-contact fusing apparatus of the back end means 35 includes first and second radiant heat sources 48, 50 for heating and fusing the toner image on the substrate 46, the multiple function roller 40 for holding and rotatably transporting the image carrying substrate 46 thereon past the second heat source 50. The non-contact fusing apparatus further includes control means for selectively activating and deactivating the second radiant heat source 50 relative to the movement of the substrate past such source.

After the toner image is transferred as above to the substrate 46, continued rotation of the roller 40, with the substrate still being held thereon, will bring the leading and eventually the trailing edge of such substrate 46 past a first sensor 72, then completely past the second radiant heat source 50, and finally past a second sensor 74. The sensors 72 and 74 function to turn the second heat source 50 on and off in relation to the movement of such substrate 46 with the roller 40. As illustrated, the heat source 50, which is longitudinally coextensive with the roller 40, includes longitudinally extending infrared lamps 76, 78.

Lamps 76, 78 are selected so as to be capable of emitting infrared flux within a range that includes wave lengths less than 2 micrometers. Infrared wavelengths below 2 micrometers are absorbable by the colored toner particles forming the image being fused, but are not readily absorbable, for example, by substrates of paper. As such, when the lamps 76, 78 are turned on, the heat they emit will not be absorbed by paper substrates, for example, but will be readily absorbed by the toner image on such substrates. Consequently, when substrates such as paper are being run, substantially all the heat emitted will be used up in heat melting or fusing the toner image on such substrate. The source 50 therefore only needs to be capable of raising the temperature of the toner image to the melting or fusing point, thereby making such non-contact fusing apparatus of the present invention very heat efficient.

The source 50 also includes an insulative hood 80, which has a reflective inner surface 82 about the lamps 76, 78. The hood 80 serves to reflect and concentrate the heat emitted by the lamps 76, 78 onto the toner image on the substrate 46 being transported thereunder. The hood 80 as such also contributes to the heat efficiency of the heat source 50.

Furthermore, in order to ensure the heat efficiency of the source 50 when fusing at wave lengths, for example, greater than 2 micrometers, the outside surface of the roller 40 is preheated by the first radiant heat source 48. Roller 40 is preheated as such, to a temperature for example of 120° F., which should be less than the melting or fusing temperature of any toner forming the images being fused. To enhance such preheating at all wavelengths, the outside surface of the roller 40 should additionally be painted black.

As illustrated, the preheating heat source 48 is similar to the source 50 in that it includes a pair of infrared lamps 84, 86, and an insulative hood 88 with a reflective inner surface 90. However, the flux emitted by the lamps 84, 86 is not restricted to any particular wavelength range. Additionally, the on and off cycling of the lamps 84, 86 may be controlled in a conventional manner by means of the LCU 70 and a surface temperature sensor (not shown).

The preheating of the roller 40 by the source 48 to a temperature of no more than 120° F. does not detrimentally affect image transfer, as described above. In fact such preheating advantageously improves the relative humidity and sensitivity of the outer layer of roller 40, thereby improving electrostatic image transfer.

Preheating the roller 40 also serves to preheat the image carrying substrate 46 being held thereon as described above. When such substrate 46 is fed to and held tightly against the preheated black surface 42 of the roller 40, the substrate will be adequately preheated by the time it is moved past the heat source 50. Such preheating of the substrate 46 is particularly effective due, in addition, to the vacuum effect of the source 66 which exhausts and removes substantially all the air that would otherwise have been an insulative layer between the substrate 46 and the outside surface 42 of the roller 40. The vacuum means for holding the substrate 46 to the roller 40, is therefore preferable over other means, such as gripping fingers.

Preheating the toner image carrying substrate 46 as such is also important because it functions to enhance the fused quality of the images. This is because such preheating substantially evens out the rate of retention of absorbed heat, between high and low toner density image areas on the substrate, as such areas pass under the heat source 50. It has been found that without such preheating, a high density toner image area, even while losing absorbed heat to the unheated substrate, tends to retain a sufficient quantity of such heat within the dense mass or agglomeration of its toner particles, thereby enabling adequate fusing of such toner mass or agglomeration. Unfortunately however, a low density toner image area, without comparable toner particle mass or agglomeration, tends instead to quickly lose its absorbed heat to the unheated substrate, and as such it retains very little of such heat, and therefore results in poor or inadequate fusing of such toner.

Additionally, the preheating and temperature control of the outside surface of the roller 40, (and hence the desirable preheating of the substrate 46) can also be improved by means of an auxiliary heat source 92, such as a quartz lamp. The source 92 for example, may be used simply for keeping the hollow interior 68 of the roller 40 warm.

In the present invention, the preheating of the image carrying substrate 46 also serves to advantageously heat relax the substrate 46 prior to it being subjected to the relatively high fusing heat of the source 50, for example. Such heat relaxation is particularly important in the case of plastic film substrates which are susceptible to a significant "wavy" or corrugated" surface distortion when subjected to such fusing heat without prior heat relaxation. Using plastic film substrate plates that are adequately thick, for example, seven to nine mils, and heat relaxing them as above, have been found to substantially reduce or eliminate such distortion. In addition, it has also been found that such distortion will be further reduced or eliminated by feeding such plastic film plates, for pick up by the roller 40, such that the machine oriented polymer chains of the plates or substrates 46 are perpendicular to the longitudinal axis of the roller 40.

As described above, the back end means 35 of the present invention, are capable of being operated effectively as non-contact fusing means in a non-contact fusing mode. Accordingly, it can be so operated under the control of the LCU 13, simply by a device 53 retracting and keeping the heated fusing roller 52 in spaced relationship with the roller 40. With the roller 52 retracted as such, toner image carrying substrates 46 being transported by the roller 40, can thus be moved without contact, past the fusing lamps 76, 78, and until removed from the surface of the roller 40 by means, such as a mechanical skive (not shown). Such a substrate 46 as finished copy 55, can thereafter be moved by the system 54 to the output tray 56.

Such non-contact fusing capability of the back end means 35 is particularly useful for producing offset printing press masters on coated paper, plastic or metallic plate substrates. Ordinarily, such plate substrates are susceptible to dimensional distortion, oil contamination, and toner image offset if contacted as by a contact fuser roller. The oil contamination, for example, can come from release oil such as is typically used on the surface of the contacting fuser rollers. On a printing press master plate, such oil contamination will cause press ink to reach intended "no print" areas of the press blanket, thereby resulting in defective press-produced copies. In the present invention, such masters are produced in the non-contact fusing mode, and are therefore substantially free of such oil contamination, as well as, of other contact fusing related defects such as surface distortion and image offset.

For removing the fused substrate 46 after such non-contact fusing, the roller 42 may in addition include a vacuum barrier device 94 that is fixed relative to the inside surface of the roller 40. The device 94 is mounted, as shown, within the hollow 68 of the roller 40, and such that it is to the side opposite the fusing heat source 50. The device 94 covers a small portion of the inside surface of the shell 62 from one end to the other. Device 94 further includes vacuum shields 96 and 98 which can effectively seal against the inside of the rotating shell 62, thereby preventing vacuum effect or action through any holes 70 traveling counter clockwise over the barrier 94 between such seals 96, 98. As such, air is pulled into the hollow 68 of the roller 40 only through such holes 70 that are traveling counter clockwise from the shield 98, past the heat source 50, to the shield 96. Such a vacuum effect will of course hold an image carrying substrate 46 tightly against the surface of the roller 40 from its pickup point, as shown, through the nip 30, and until it reaches its removal point near the shield 96.

After that, further rotation of the roller 40, past the shield 96, will cause the holes 70 underneath the substrate 46 to lose vacuum. Such loss of vacuum first frees the leading edge of the substrate, and eventually the whole substrate as the roller 40 continues to rotate, counter clockwise, thereby enabling the substrate to be easily removed therefrom. Another advantage of the vacuum barrier 94 is to enhance the hold down effectiveness of the vacuum source 66 on the substrate 46, by concentrating the air intake of the source 166 only through the holes 70 traveling from the shield 98 to the shield 96 as described above.

Accordingly, a toner image transferred onto the substrate 46 within the image transfer nip 30, can be effectively fused onto such substrate, advantageously as described above, without contacting the image.

Alternatively, the equipment 10 under control of the LCU 13, can also be operated in the contact fusing mode in which the toner image on the substrate 46 is fused by contacting and pressing such image onto the substrate 46. Apparatus for such contact fusing includes the multiple function roller 40 for holding and rotatably transporting the toner image carrying substrate 46 thereon, following the transfer of the toner image, as above, thereonto, and the rotatable fuser roller 52 that is movable between an out-of-contact position and a contact position relative to the multiple function roller 40. The contact fusing apparatus further includes control means including an articulating device 53 for moving the fuser roller 52 from its out-of-contact position to its contact position, and a fusing nip 100 formed by the fuser roller 52 and the roller 40 when the fuser roller is moved into its contact position with the roller 40.

In the present invention, toner image transfer to a substrate 46 for contact fusing purposes is exactly the same as it is in the case of non-contact fusing, as described above. As such, the contact fusing apparatus of the back end means 35 are therefore not separate from the non-contact fusing apparatus, but are in fact partially common and cooperative therewith.

As shown, the fuser roller 52 can be a conventional fuser roller, and may be heated externally, by a suitable heat source, or internally by a heat source 102. As such, the roller 52 may consist of a thermally conductive core 104 and an overcoat layer 106 of a thermally conductive, compliant elastomer, for example, silicone rubber. Roller 52 is rotatable, for example, in the direction of arrow 108 so as to cooperate with the roller 40 to contact fuse, press, and feed a substrate 46 through the nip 100. Within the nip 100 the multiple function roller 40 acts as a backside pressure roller, so that the fuser roller 52 can directly contact and press the toner image onto the substrate 46 being fed through such nip. Such feeding of the substrate 46 is effective even after the vacuum effect of the source 66 has been cut off from such substrate 46 by the vacuum shield 94. The shield 94 therefore may be located at or just downstream of the center of the fusing nip 100.

When operating the equipment 10 in the contact fusing mode, toner images on a substrate 46 (which is being held on the roller 40) may be heated to their melting or fusing point by either the heat source 50 or the heated fuser roller 52, or by a combination thereof. Additionally, the preheat source 48 may or may not be activated. The heat source 102, which can be a quartz lamp, must therefore be capable of heating the roller 52 so that the temperature of the surface of the roller can be controlled conventionally at the fusing temperature of the particular toner being used.

As is well known, release oil may also be applied to the surface of the fuser roller 52, and the substrate 46, after exiting the fusing nip 100, may be removed from the surface of roller 52 by a suitable skive (not shown). The surface of the roller 52 may additionally be specially textured for imparting a desired finish to, or for glossing, the image being fused.

As pointed out, during the entire period when the back end means 35 is in the contact fusing mode, the fuser roller 52 will be extended and held in the required nip contact with the roller 40 by means of the articulating device 53. The device 53 can, for example, be an air cylinder, or other suitable mechanical or electromechanical device, that is connected to the roller 52 and to the LCU 13. As such, it can be selectively actuated to move the roller 52 into, or out of contact with the roller 40.

As can be seen, the present invention provides a simple and cost effective copier or printer 10 which includes, not separate apparatus, but partially and cooperative apparatus for effecting (a) toner image transfer, (b) contact fusing of ordinary finished copies by contacting such images, and (c) non-contact fusing of printing press plate masters without contacting such images. Such copies can be produced as such on plain and coated paper, and on other such suitable substrates including plastic films and metallic plates. The multiple function means, or the back end means 35 includes the multiple function fusing and image transfer roller 40 that, as described above, cooperatively forms part of image transfer apparatus, part of non-contact fusing apparatus, and part of contact fusing apparatus in such back end means 35.

As such, the copier or printer 10 of the present invention, under the control of its logic and control unit 13, is capable of effecting image transfer, and selectively capable of operating in either a contact fusing mode, or in a non-contact fusing mode. The non-contact fusing mode is particularly suitable for producing printing press masters such that the masters are free of contact-related defects such as dimensional distortion, oil contamination, and toner offset.

Additionally, the preheated multiple function roller 40 of the back end means 35, and the vacuum means for holding down a substrate 46 on such roller, cooperate effectively to enhance the fusing quality, as well as, the heat efficiency of the fusing means of such equipment.

Although the present invention has been described with reference to a particular embodiment, it is understood that modifications and variations thereof can be effected within the scope and spirit of such invention.

What is claimed is:

1. Electrostatographic equipment for producing fused toner images on a variety of substrates such as paper, plastic film and metallic printing press plates, the equipment comprising:

(a) front end means including an image bearing member, for electrostatically forming image patterns of an original image on such image bearing member, and for developing such image patterns with fusible toner particles to form a toner image; and (b) back end means including a rotatable multiple function fusing and image transfer device having means for receiving and holding a suitable substrate thereon, said multiple function device forming part of image transfer apparatus for transferring said toner image onto said substrate, and said back end means further including (i) non-contact fusing apparatus, including a radiant heat source positioned about said multiple function device in heating relationship with the outer surface area of said multiple function device, for fusing said toner image onto said substrate without contacting said image, (ii) contact fusing apparatus for fusing said toner image by contacting and pressing said image onto said substrate, and (iii) control means for switching said equipment between a non-contact fusing made and a contact fusing mode.

2. The equipment of claim 1 wherein said image transfer apparatus for transferring said toner image onto said substrate includes:

(a) the image bearing member of said front end means for movably carrying said toner image thereon;

(b) said rotatable multiple function device being a roller having a rotatable shell, a hollow interior, an outer surface area for receiving and holding said substrate thereon, and holes formed in said roller communicating between said interior and said outer surface area of said roller;

(c) an image transfer nip formed by said image bearing member and said multiple function device;

(d) vacuum means including a vacuum source connected to one end of said roller for creating a vacuum inside said interior of said roller; and (e) means for feeding a substrate in a timed and registered manner onto said outer surface area of said multiple function device such that said substrate is received and held thereonto for rotation therewith through said image transfer nip.

3. The equipment of claim 1 wherein said non-contact fusing apparatus includes:

(a) said radiant heat source for non-contact heating and fusing of said toner image on said substrate without contacting said image;

(b) said rotatable multiple function device for holding and rotatably transporting said substrate thereon, following transfer of said toner image onto said substrate, past said radiant heat source; and (c) control means for selectively activating and deactivating said radiant heat source for such non-contact heating and fusing of said toner image.

4. The equipment of claim 1 wherein said contact fusing apparatus includes:

(a) said rotatable multiple function device for holding and rotatably transporting said substrate thereon, following the transfer of said toner image onto said substrate;

(b) a rotatable fuser roller including means for heating said fuser roller to a desired temperature for fusing said toner image, said fuser roller being movable between an out-of-contact position and a contact position with said multiple function device;

(c) control means for selectively moving said fuser roller from said out-of-contact spaced position, into said contact position with said multiple function device; and (d) a fusing nip formed by said fuser roller and said rotatable multiple function device when said fuser roller is moved into said contact position with said multiple function device, such that said multiple function device can act as a backside pressure member and said fuser roller can directly contact and press said toner image onto said substrate being held by said multiple function device.

5. The equipment of claim 2 wherein said shell of said multiple function roller includes a metallic core and at least a single elastomeric overlayer.

6. The equipment of claim 2 wherein said image transfer apparatus further includes a vacuum barrier positioned inside said multiple function roller for preventing vacuum action over a portion of the outside surface of said multiple function roller.

7. The equipment of claim 3 wherein said rotatable multiple function device is a roller.

8. The equipment of claim 4 wherein said rotatable multiple function device is a roller.

9. The equipment of claim 4 wherein said control means includes electromechanical means for moving said fuser roller from said out of contact position into said contact position.

10. The equipment of claim 1 having a plurality of said radiant heat source said plurality of said radiant heat source including first and second sources, such that said first source merely preheats said outer surface area of said multiple function roller, while said second source heats and fuses the toner images on the substrate being held on said multiple function roller.

11. The equipment of claim 9 wherein said means for moving said fuser roller as such is a pneumatic air cylinder.

12. The equipment of claim 1 wherein said multiple function fusing and image transfer device includes a drum and means for internally heating said drum.

* * * * *